United States Patent [19]

Sawada et al.

[11] Patent Number: 4,858,439

[45] Date of Patent: Aug. 22, 1989

[54] DEVICE FOR VARYING A STROKE

[75] Inventors: Daisaku Sawada, Gotenba; Takeshi Takahashi, Mishima, both of Japan

[73] Assignee: Toyota Jidosha Kabushiki Kaisha, Japan

[21] Appl. No.: 156,576

[22] Filed: Feb. 17, 1988

[30] Foreign Application Priority Data

Mar. 3, 1987 [JP] Japan ..... 62-046834

[51] Int. Cl.[4] ..... F15B 15/00

[52] U.S. Cl. ..... 60/583; 60/592; 92/38; 92/60; 92/83; 92/86; 92/142; 277/73; 277/74; 277/212 FB; 239/102.2; 239/533.8

[58] Field of Search ..... 60/533, 545, 583, 584, 60/592, 571, 572, 585; 92/38, 60, 83, 86.5, 142, 165 R, 86; 277/73, 74, 75, 212 FB; 239/102.2, 533.3, 533.8

[56] References Cited

U.S. PATENT DOCUMENTS

| | | | |
|---|---|---|---|
| 1,805,802 | 5/1931 | Browne | 60/533 |
| 3,234,739 | 2/1966 | Pierce, Jr. | 60/592 |
| 3,423,937 | 1/1969 | Wagstaffe | 92/38 |
| 3,751,988 | 8/1973 | Reese, Sr. | 92/38 X |
| 3,877,226 | 4/1975 | Blum | 60/545 |
| 4,463,663 | 8/1984 | Hanson, Jr. et al. | 92/86 X |

FOREIGN PATENT DOCUMENTS

| | | | |
|---|---|---|---|
| 2057639 | 6/1971 | Fed. Rep. of Germany | 60/533 |
| 1141131 | 4/1957 | France | 277/212 FB |
| 879758 | 10/1961 | United Kingdom | 60/533 |

*Primary Examiner*—Robert E. Garrett
*Assistant Examiner*—Mark A. Williamson
*Attorney, Agent, or Firm*—Oliff & Berridge

[57] ABSTRACT

A stroke variable device comprising a large diameter cylinder and a small diameter cylinder which are interconnected to each other. A large diameter piston and a small diameter piston are slidably inserted into the large diameter cylinder and the small diameter cylinder, respectively, and a cylinder chamber is formed between the inner end of the large diameter piston and the inner end of the small diameter piston. A first seal member is arranged to surround the projecting outer end of the large diameter piston, and a second seal member is arranged to surround the projecting outer end of the small diameter piston. One end of the first seal member is fixed to the projecting outer end of the large diameter piston, and the other end thereof is fixed to the housing of the device to form a first hermetically sealed chamber therein. In addition, one end of the second seal member is fixed to the projecting outer end of the small diameter piston, and the other end thereof is fixed to the housing of the device to form a second hermetically sealed chamber therein. The cylinder chamber and both hermetically sealed chambers are filled with oil.

20 Claims, 4 Drawing Sheets

DEVICE FOR VARYING A STROKE

BACKGROUND OF THE INVENTION

1. Field of the Invention

The present invention relates to a device for varying a stroke.

2. Description of the Related Art

In a known device for varying a stroke, the device comprises two interconnected cylinders. One of the cylinders has a diameter larger than the diameter of the other cylinder, and two pistons each having a diameter matching the different diameters of the two cylinders are inserted in the respective cylinders. The cylinder chamber formed between the pistons in the cylinders having different diameters is then filled with oil (Japanese Unexamined Patent Publication No. 48-4823). In this device, the piston having a larger diameter than the other piston is actuated by an actuator and, at this time, the smaller diameter piston is moved by a stroke greater than that of the larger diameter piston.

However, in this device, since the oil in the cylinder chamber is forced out of the cylinder chamber via the clearance between the larger diameter piston and the larger diameter cylinder or via the clearance between the smaller diameter piston and the smaller diameter cylinder, a problem arises in that an oil supply device must be provided to feed replacement oil into the cylinder chamber. In addition, another problem arises in that measures must be taken to prevent the formation of air bubbles in the oil in the cylinder chamber.

SUMMARY OF THE INVENTION

An object of the present invention is to provide a device capable of varying a stroke, which device does not need an oil supply device for feeding replacement oil into the cylinder chamber and does not require measures to be taken to prevent the formation of air bubbles in the oil in the cylinder chamber.

According to the present invention, there is provided a device for varying a stroke, comprising: a cylinder housing having therein a large diameter cylinder and a small diameter cylinder which are interconnected to each other; a large diameter piston slidably inserted into the large diameter cylinder and having a projecting end portion which projects from the cylinder housing; a small diameter piston slidably inserted into the small diameter cylinder and having a projecting end portion which projects from the cylinder housing, the large diameter piston and the small diameter piston defining a cylinder chamber therebetween; a first flexible annular seal member fixed to the projecting end portion of the large diameter piston in a fluid tight manner at one end thereof and fixed to an outer wall of the cylinder housing in a fluid tight manner at the other end thereof to define a first hermetically sealed chamber therein; a second flexible annular seal member fixed to the projecting end portion of the small diameter piston in a fluid tight manner at one end thereof and fixed to the outer wall of the cylinder housing in a fluid tight manner at the other end thereof to define a second hermetically sealed chamber therein; and an incompressible fluid filling the cylinder chamber, the first hermetically sealed chamber and the second hermetically sealed chamber.

The present invention may be more fully understood from the description of preferred embodiments of the invention set forth below, together with the accompanying drawings

DESCRIPTION OF THE PREFERRED EMBODIMENTS

Figure 1:
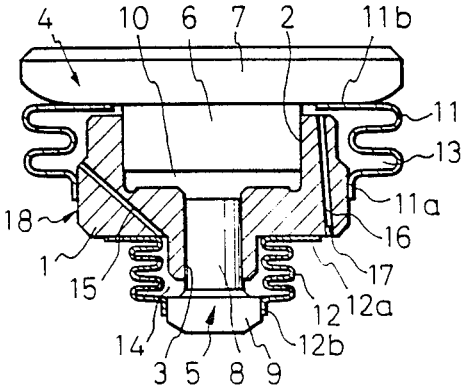
FIG. 1 is a cross-sectional side view of a stroke variable device according to the present invention.

Referring to FIG. 1, reference numeral 1 designates a cylinder housing, 2 a large diameter cylinder formed in the cylinder housing 1, 3 a small diameter cylinder formed in the cylinder housing 1 and connected to the increased diameter cylinder 2, 4 a large diameter piston, and 5 a small diameter piston. The large diameter piston 4 comprises a piston portion 6 and an enlarged head portion 7, and the piston portion 6 is slidably inserted into the large diameter cylinder 2. The small diameter piston 5 also comprises a piston portion 8 and an enlarged head portion 9, and the piston portion 8 is slidably inserted into the small diameter cylinder 3. A cylinder chamber 10 is formed between the piston portion 6 of the large diameter piston 4 and the piston portion 8 of the small diameter piston 5. In the embodiment illustrated in FIG. 1, the cylinder housing 1, the large diameter piston 4 and the small diameter piston 5 are made of a metallic material.

As illustrated in FIG. 1, a first annular seal member 11 is arranged between the cylinder housing 1 and the large diameter piston 4. This seal member 11 is made of a flexible material, and thus is able to expand and contract in the axial direction of the large diameter piston 4. A second annular seal member 12 is arranged between the cylinder housing 1 and the small diameter piston 5. This seal member 12 is also made of a flexible material, and thus is able to expand and contract in the axial direction of the small diameter cylinder 5. One end 11*a* of the first seal member 11 is fixed to the outer wall of the cylinder housing 1 in a fluid tight manner, and the other end 11*b* of the first seal member 11 is fixed to the enlarged head portion 7 of the large diameter piston 4 in a fluid tight manner. One end 12*a* of the second seal member 12 is fixed to the outer wall of the cylinder housing 1 in a fluid tight manner, and the other end 12*b* of the second seal member 12 is fixed to the enlarged head portion 9 of the small diameter piston 5 in a fluid tight manner. Consequently, a first hermetically sealed chamber 13 is formed in the interior of the first seal member 11, and a second hermetically sealed chamber 14 is formed in the interior of the second seal member 12. In the embodiment illustrated in FIG. 1, the seal members 11 and 12 are formed by metallic bellows, and a ratio of the effective cross-sectional area of the first hermetically sealed chamber 13 to the effective cross-sectional area of the second hermetically sealed chamber 14 is substantially equal to a ratio of the cross-sectional area of the large diameter cylinder 2 to the cross-sectional area of the small diameter cylinder 3. The hermetically sealed chambers 13 and 14 are interconnected via a connecting bore 15 formed in the cylinder housing 1, and a fluid filling bore 16 connected to the first hermetically sealed chamber 13 is formed in the cylinder housing 1. The first hermetically sealed chamber 13, the second hermetically sealed chamber 14 and the cylinder chamber 10 are filled with an incompressible fluid fed therein from the fluid filling bore 16.

The method of filling the chambers 10, 13, 14 with the incompressible fluid will be now described. After all of the component parts are assembled in the cylinder housing 1, as illustrated in FIG. 1, air in the hermetically sealed chambers 13, 14 and the cylinder chamber 10 is drawn out via the fluid filling bore 16 until a vacuum is created in these chambers 10, 13, 14. Then, a degassed incompressible fluid, for example, a fuel or an oil such as silicon oil, is fed into the fluid filling bore 16 in a pressurized state. When the oil is fed into the fluid filling bore 16, the oil fed into the first hermetically sealed chamber 13 is introduced to the second hermetically sealed chamber 14 via the connecting bore 15, and introduced to the cylinder chamber 10 via the clearance between the large diameter cylinder 2 and the piston portion 6 or via the clearance between the small diameter cylinder 3 and the piston portion 8. Subsequently, the hermetically sealed chambers 13, 14 and the cylinder chamber 10 are filled with an oil at the same pressure and, at this time, both pistons 4 and 5 are moved to corresponding positions determined by the piston biasing force of the oil and by the resilient force of the seal members 11, 12. The inlet 17 of the fluid filling bore 16 is then closed by, for example, welding.

The outer wall portion 18 of the cylinder housing 1 between the first seal member 11 and the second seal member 12 is exposed to the outside air, and is used for supporting the stroke variable device in a stationary state illustrated in FIG. 1. When a downward force is imposed on the large diameter piston 4 while the outer wall portion 18 of the cylinder housing 1 is supported in a stationary state, and accordingly, the large diameter piston 4 is moved downward by a stroke S, the small diameter piston 5 is moved downward by a distance (cross-sectional area of large diameter cylinder 2/cross-sectional area of small diameter cylinder 3) S. Subsequently, when the large diameter piston 4 is moved upward by the distance S, the small diameter piston 5 is moved upward by a distance (cross-sectional area of large diameter cylinder 2/cross-sectional area of the small diameter cylinder 3) S, and thus returned to the initial position thereof. Since the small diameter piston 5 is normally arranged to actuate a member, when the large diameter piston 4 is moved downward, the pressure of the oil in the cylinder chamber 10 is increased. Consequently, at this time, a part of the oil in the cylinder chamber 10 is forced into the hermetically sealed chambers 13 and 14 via the clearance between the large diameter cylinder 2 and the piston portion 6 and via the clearance between the small diameter cylinder 3 and the piston portion 8, causing an increase in the pressure of the oil in the hermetically sealed chambers 13 and 14. Conversely, when the large diameter piston 4 is returned to the initial upper position, the pressure in the cylinder chamber 10 becomes lower than that in the hermetically sealed chambers 13 and 14 and the oil in the hermetically sealed chambers 13 and 14 flows into the cylinder chamber 10, and thus the cylinder chamber 10 is filled with oil. As mentioned above, since the oil is previously degassed, there is no danger of a formation of bubbles in the oil within the cylinder chamber 10.

Where the first hermetically sealed chamber 13 has a completely hermetic construction, when the large diameter piston 4 is moved downward, the pressure in the first hermetically sealed chamber 13 is increased, and thus a force is generated to prevent the downward movement of the large diameter piston 4. Similarly, where the second hermetically sealed chamber 14 has a completely hermetic construction, when the small diameter piston 5 is moved upward, the pressure in the second hermetically sealed chamber 14 is increased, and thus a force is generated to prevent the upward movement of the small diameter piston 5. However, in the embodiment illustrated in FIG. 1, since the hermetically sealed chambers 13 and 14 are interconnected via the connecting bore 15, when the large diameter piston 4 moves downward, the oil in the first hermetically sealed chamber 13 is fed into the second hermetically sealed chamber 14, the volume of which is increasing, via the connecting bore 15. Consequently, the pressure in the first hermetically sealed chamber 13 is not increased, and thus it is possible to avoid the generation of a force preventing the downward movement of the large diameter piston 4. This holds true also for the small diameter piston 5.

In addition, as mentioned above, in the embodiment illustrated in FIG. 1, a ratio of the effective cross-sectional area of the first hermetically sealed chamber 13 to the effective cross-sectional area of the second hermetically sealed chamber 14 is substantially equal to a ratio of the cross-sectional area of the large diameter cylinder 2 to the cross-sectional area of the small diameter cylinder 3. Consequently, when the large diameter piston 4 is moved downward, the reduction in the volume of the first hermetically sealed chamber 13 is substantially equal to the increase in the volume of the second hermetically sealed chamber 14. In addition, when the small diameter piston 5 is moved upward, the reduction in the volume of the second hermetically sealed chamber 14 is substantially equal to the increase in the volume of the first hermetically sealed chamber 13. Consequently, when the pistons 4 and 5 are moved, the pressure in the hermetically sealed chambers 13 and 14 is not changed, and thus it is possible to avoid a prevention of the movement of the pistons 4 and 5 by an increase in the pressure of the oil.

FIGS. 2 through 5 illustrate separate embodiments of a stroke variable device according to the present invention. In these embodiments, similar components are indicated by the same reference numerals used in FIG. 1. In addition, in these embodiments, a ratio of the effective cross-sectional area of the first hermetically sealed chamber defined by the first seal member to the effective cross-sectional area of the second hermetically sealed chamber defined by the second seal member is substantially equal to a ratio of the cross-sectional area of the large diameter cylinder to the cross-sectional area of the small diameter cylinder, and the first hermetically sealed chamber and the second hermetically sealed chamber are interconnected via the connecting bore.

Figure 2:
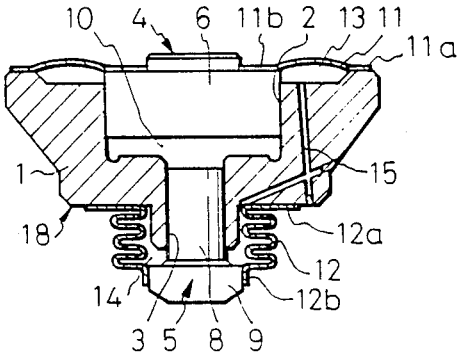
FIG. 2 is a cross-sectional side view of another embodiment of a stroke variable device according to the present invention.

In the embodiment illustrated in FIG. 2, the first seal member 11 is formed by a diaphragm which is made of a metallic material. In addition, in this embodiment, the inner end portion 11*b* of the first seal member 11 is fixed to the top face of the large diameter piston 4 in a fluid tight manner.

Figure 3:
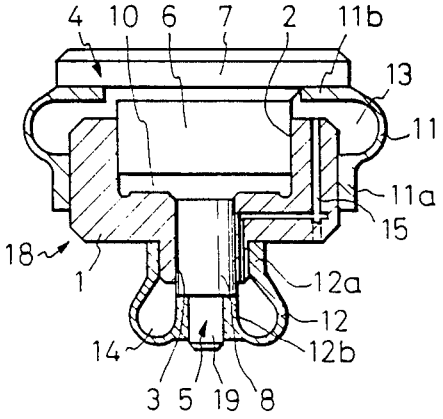
FIG. 3 is a cross-sectional side view of a further embodiment of a stroke variable device according to the present invention.

In the embodiment illustrated in FIG. 3, the first seal member 11 and the second seal member 12 are made of rubber. In addition, in this embodiment, the small diameter piston 5 has a shrunken end portion 19 integrally formed on the piston portion 8, and the end portion 12*b* of the second seal member 12 is fixed to that shrunken end portion 19 in a fluid tight manner.

Figure 4:
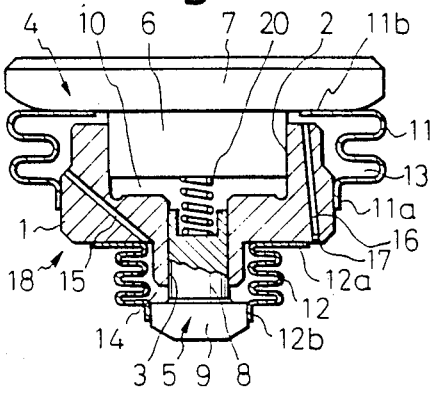
FIG. 4 is a cross-sectional side view of a still further embodiment of a stroke variable device according to the present invention.

In the embodiment illustrated in FIG. 4, a compression spring 20 is inserted between the large diameter piston 4 and the small diameter piston 5. Where the stroke variable device is constructed so that the large diameter piston 4 is urged by an actuator, and a driven member is urged by the small diameter piston 5, it is possible to pre-load the actuator by the compression spring 20.

Figure 5:
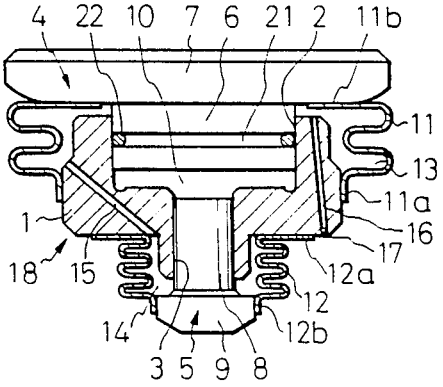
FIG. 5 is a cross-sectional side view of a still further embodiment of a stroke variable device according to the present invention.

In the embodiment illustrated in FIG. 5, to adjust the amount of leakage of oil flowing through the clearance between the large diameter piston 4 and the large diameter cylinder 2, a ring groove 21 is formed on the piston portion 6 of the large diameter piston 4, and an O ring 22 is fitted in the ring groove 21.

Figure 6:
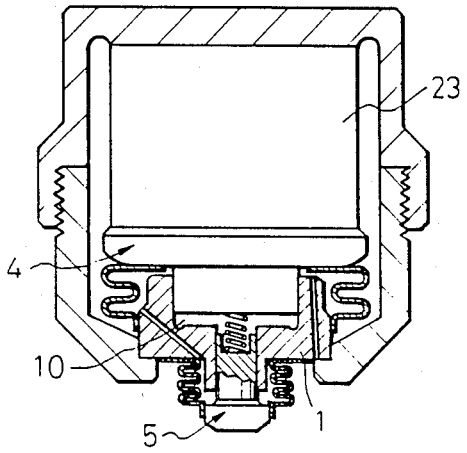
FIG. 6 is a cross-sectional side view of a practical example of a stroke variable device according to the present invention.
Figure 7:
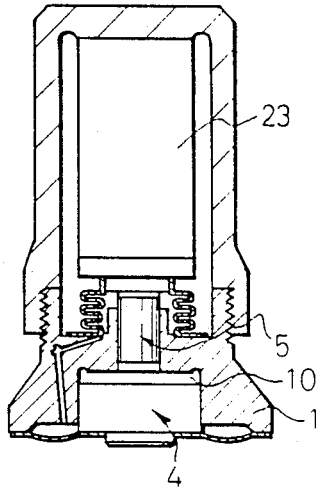
FIG. 7 is a cross-sectional side view of an alternative practical example of a stroke variable device according to the present invention.
Figure 8:
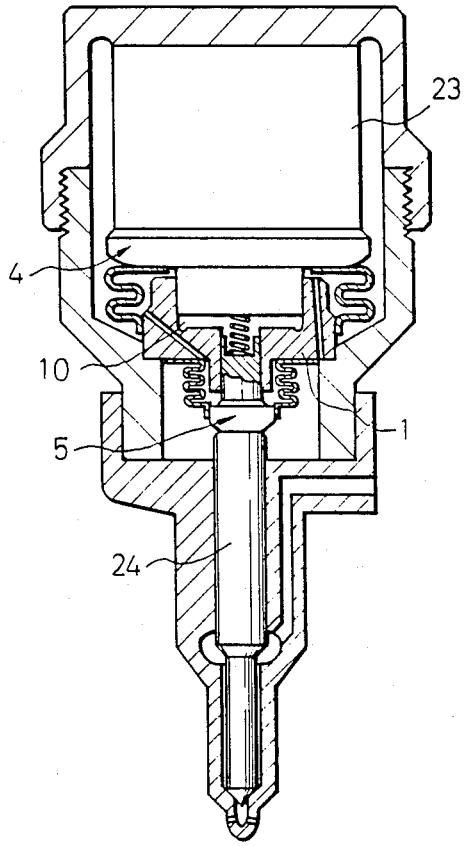
FIG. 8 is a cross-sectional side view of a fuel injector.

FIG. 6 illustrates a practical example of the stroke variable device illustrated in FIG. 4, and FIG. 7 illustrates a practical example of the stroke variable device illustrated in FIG. 2. In FIGS. 6 and 7, reference numeral 23 designates a piezoelectric element. This piezoelectric element 23 expands in the longitudinal direction thereof in an extremely short time when a voltage is applied thereto, and contracts to the original length thereof in an extremely short time when the voltage charge is discharged from the piezoelectric element 23. FIG. 6 illustrates the case where the small diameter piston 5 is moved by a stroke which is larger than the amount of expansion of the piezoelectric element 23, and FIG. 7 illustrates the case where the large diameter piston 4 is moved by a stroke which is smaller than the amount of expansion of the piezoelectric element 23. When the practical example illustrated in FIG. 6 is applied to a fuel injector, the small diameter piston 5 is arranged so that the bottom face thereof impinges upon the needle 24, as illustrated in FIG. 8. In this case, if the stroke variable device is inserted between the piezoelectric element 23 and the needle 24 in a state where the large diameter piston 4 and the small diameter piston 5 are moved inward, the pressure of the oil in the cylinder chamber 10 becomes high, and thus it is possible to pre-load the piezoelectric element 23.

The stroke variable devices illustrated in FIGS. 1 through 5 can bear a considerably high load. In addition, taking into account the movement of the oil from the cylinder chamber 10 to the hermetically sealed chambers 13, 14, these stroke variable devices are particularly suitable for usages in which the large diameter piston 4 and the small diameter piston 5 are moved at a high speed and, therefore, as illustrated in FIGS. 6 and 7, these stroke variable devices can be used in combination with the piezoelectric element 23. In addition, in any stroke variable device, there is an advantage in that each seal member functions as a cooling fin for dissipating heat generated in the oil.

According to the present invention, an oil supply device for feeding oil to the cylinder chamber is not necessary, and there is no danger of the formation of air bubbles in the oil in the cylinder chamber. In addition, there is no danger of an oil leakage out of the stroke variable device.

While the invention has been described by reference to specific embodiments chosen for purposes of illustration, it should be apparent that numerous modifications could be made thereto by those skilled in the art without departing from the basic concept and scope of the invention.

We claim:

1. A device for varying a stroke, comprising:

a cylinder housing having therein a large diameter cylinder and a small diameter cylinder which are interconnected to each other;

a large diameter piston slidably inserted into said large diameter cylinder and having a projecting end portion which projects from said cylinder housing;

a small diameter piston slidably inserted into said small diameter cylinder and having a projecting end portion which projects from said cylinder housing, said large diameter piston and said small diameter piston defining a cylinder chamber therebetween;

a first flexible annular seal member fixed to the projecting end portion of said large diameter piston in a fluid tight manner at one end thereof and fixed to an outer wall of said cylinder housing in a fluid tight manner at the other end thereof to define a first hermetically sealed chamber therein;

a second flexible annular seal member fixed to the projecting end portion of said small diameter piston in a fluid tight manner at one end thereof and fixed to the outer wall of said cylinder housing in a fluid tight manner at the other end thereof to define a second hermetically sealed chamber therein; and an incompressible fluid filling said cylinder chamber, said first hermetically sealed chamber and said second hermetically sealed chamber.

2. A device according to claim 1, wherein said cylinder housing has a connecting bore formed therein and interconnecting said first hermetically sealed chamber to said second hermetically sealed chamber.

3. A device according to claim 2, wherein said first hermetically sealed chamber has an effective cross-sectional area which is larger than that of said second hermetically sealed chamber.

4. A device according to claim 3, wherein a ratio of the effective cross-sectional area of said first hermetically sealed chamber to the effective cross-sectional area of said second hermetically sealed chamber is substantially equal to a ratio of a cross-sectional area of said large diameter cylinder to a cross-sectional area of said small diameter cylinder.

5. A device according to claim 1, wherein said large diameter piston has an outer end face positioned opposite to said cylinder chamber, and said first flexible annular seal member is fixed to the outer end face of said large diameter piston.

6. A device according to claim 1, wherein said large diameter piston has an enlarged head portion at the projecting end portion thereof, and said first flexible annular seal member is fixed to the enlarged head portion of said large diameter piston.

7. A device according to claim 1, wherein said small diameter piston has an outer end face positioned opposite to said cylinder chamber, and said second flexible annular seal member is fixed to the outer end face of said small diameter piston.

8. A device according to claim 7, wherein said small diameter piston has a shrunken end portion formed on the outer end face thereof, and said second flexible annular seal member is fixed to the shrunken end portion of said small diameter piston.

9. A device according to claim 1, wherein said small diameter piston has an enlarged head portion at the projecting end portion thereof, and said second flexible annular seal member is fixed to the enlarged head portion of said small diameter piston.

10. A device according to claim 1, wherein said large diameter piston has a piston portion slidably inserted into said large diameter cylinder and having a ring groove and an O ring which is fitted into said ring groove.

11. A device according to claim 1, wherein said cylinder chamber has a compression spring arranged therein between said large diameter piston and said small diameter piston.

12. A device according to claim 1, wherein at least one of said first flexible annular seal member and said second flexible annular seal member is made of a metallic material.

13. A device according to claim 1, wherein at least one of said first flexible annular seal member and said second flexible annular seal member is made of a rubber material.

14. A device according to claim 1, wherein at least one of said first flexible annular seal member and said second flexible annular seal member has a bellows shape.

15. A device according to claim 1, wherein said first flexible annular seal member has a diaphragm shape.

16. A device according to claim 1, wherein said incompressible fluid is a fuel.

17. A device according to claim 1, wherein said incompressible fluid is a degassed oil.

18. An actuator comprising:

a cylinder housing having therein a large diameter cylinder and a small diameter cylinder which are interconnected to each other;

a large diameter piston slidably inserted into said large diameter cylinder and having a projecting end portion which projects from said cylinder housing;

a small diameter piston slidably inserted into said small diameter cylinder and having a projecting end portion which projects from said cylinder housing, said large diameter piston and said small diameter piston defining a cylinder chamber therebetween;

a first flexible annular seal member fixed to the projecting end portion of said large diameter piston in a fluid tight manner at one end thereof and fixed to an outer wall of said cylinder housing in a fluid tight manner at the other end thereof to define a first hermetically sealed chamber therein;

a second flexible annular seal member fixed to the projecting end portion of said small diameter piston in a fluid tight manner at one end thereof and fixed to the outer wall of said cylinder housing in a fluid tight manner at the other end thereof to define a second hermetically sealed chamber therein;

an incompressible fluid filling said cylinder chamber, said first hermetically sealed chamber and said second hermetically sealed chamber; and a piezoelectric element arranged to actuate said large diameter piston.

19. An actuator comprising:

a cylinder housing having therein a large diameter cylinder and a small diameter cylinder which are interconnected to each other;

a large diameter piston slidably inserted into said large diameter cylinder and having a projecting end portion which projects from said cylinder housing;

a small diameter piston slidably inserted into said small diameter cylinder and having a projecting end portion which projects from said cylinder housing, said large diameter piston and said small diameter piston defining a cylinder chamber therebetween;

a first flexible annular seal member fixed to the projecting end portion of said large diameter piston in a fluid tight manner at one end thereof and fixed to an outer wall of said cylinder housing in a fluid tight manner at other end to define a first hermetically sealed chamber therein;

a second flexible annular seal member fixed to the projecting end portion of said small diameter piston in a fluid tight manner at one end and fixed to the outer wall of said cylinder housing in a fluid tight manner at the other end thereof to define a second hermetically sealed chamber therein;

an incompressible fluid filling said cylinder chamber, said first hermetically sealed chamber and said second hermetically sealed chamber; and a piezoelectric element arranged to actuate said small diameter piston.

20. A fuel injector comprising:

a cylinder housing having therein a large diameter cylinder and a small diameter cylinder which are interconnected to each other;

a large diameter piston slidably inserted into said large diameter cylinder and having a projecting end portion which projects from said cylinder housing;

a small diameter piston slidably inserted into said small diameter cylinder and having a projecting end portion which projects from said cylinder housing, said large diameter piston and said small diameter piston defining a cylinder chamber therebetween;

a first flexible annular seal member fixed to the projecting end portion of said large diameter piston in a fluid tight manner at one end thereof and fixed to an outer wall of said cylinder housing in a fluid tight manner at the other end thereof to define a first hermetically sealed chamber therein;

a second flexible annular seal member fixed to the projecting end portion of said small diameter piston in a fluid tight manner at one end thereof and fixed to the outer wall of said cylinder housing in a fluid tight manner at the other end thereof to define a second hermetically sealed chamber therein;

an incompressible fluid filling said cylinder chamber, said first hermetically sealed chamber and said second hermetically sealed chamber;

a piezoelectric element arranged to actuate said large diameter piston; and a needle actuated by said small diameter piston.

* * * * *